US006471544B1

(12) United States Patent
Huang

(10) Patent No.: US 6,471,544 B1
(45) Date of Patent: Oct. 29, 2002

(54) FIXING STRUCTURE FOR CONNECTING A CONNECTOR AND A PRINTED CIRCUIT BOARD

(75) Inventor: Alex Huang, Taipei Hsien (TW)

(73) Assignee: Ovilux Corporation, Taipei Hsien (TW)

( * ) Notice: Subject to any disclaimer, the term of this patent is extended or adjusted under 35 U.S.C. 154(b) by 0 days.

(21) Appl. No.: 09/888,807

(22) Filed: Jun. 25, 2001

(51) Int. Cl.[7] ..... H01R 13/73
(52) U.S. Cl. ..... 439/567
(58) Field of Search ..... 439/567, 571–573, 439/570

(56) References Cited

U.S. PATENT DOCUMENTS 5,145,407 A * 9/1992 Obata et al. ..... 439/567
5,232,379 A * 8/1993 Lai ..... 439/570
5,336,111 A * 8/1994 Thrush et al. ..... 439/567
5,551,891 A * 9/1996 Huss, Jr. ..... 439/567
6,227,907 B1 * 5/2001 Wu et al. ..... 439/570

* cited by examiner

*Primary Examiner*—Gary Paumen
(74) *Attorney, Agent, or Firm*—Alan D. Kamrath; Rider, Bennett, Egan & Arundel

(57) ABSTRACT

A fixing structure includes an insulator, and multiple board locks. The insulator has multiple receptacles for mounting multiple conductors. The insulator has one side protruded with a chamfered latch boss, and has two sides formed with opposite recessed sockets each having a bottom side and an adjoining side formed with a substantially inverted T-shaped through hole. Each board lock includes an upper portion defining a substantially inverted U-shaped pivot portion, and a lower portion defining a forked insertion portion. Each of the pivot portion and the insertion portion has outer sides formed with outward protruded shoulders. The pivot portion has a middle formed with a flexible locking tab that is slightly protruded outward.

2 Claims, 11 Drawing Sheets

A–A'

FIXING STRUCTURE FOR CONNECTING A CONNECTOR AND A PRINTED CIRCUIT BOARD

BACKGROUND OF THE INVENTION

1. Field of the Invention

The present invention relates to a fixing structure for connecting a connector and a printed circuit board (P.C.B.).

2. Description of the Related Art

A conventional connector in accordance with the prior art shown in FIG. 11 comprises an insulator 40, and multiple board locks 41. The insulator 40 has multiple receptacles (not shown) for receiving multiple conductors (not shown). The housing 41 has two sides defining two opposite sockets each defining a through hole. Each board lock 41 has a pivot portion 42 inserted into the through hole of the socket of the insulator 40, and an insertion portion 43 inserted into a printed circuit board 44, such that the connector may be secured on the printed circuit board 44. The outer sides of each of the pivot portion 42 and the insertion portion 43 are formed with outward protruded shoulders 45 for providing a locking positioning effect when the board lock 41 is inserted into the insulator 40 or the printed circuit board 44. The shoulders 45 are rested on the two opposite inner walls of the socket of the insulator 40 when the pivot portion 42 of the board lock 41 is inserted into the insulator 40. However, the urging force of the shoulders 45 is not efficient enough, so that the board lock 41 is easily released and detached from the insulator 40. Alternatively, if the urging force is too large, the structure of the insulator will be broken.

SUMMARY OF THE INVENTION

The primary objective of the present invention is to provide a fixing structure for connecting a connector and a printed circuit board, wherein the housing and the board of the connector may be integrally combined rigidly and stably without detachment.

Another objective of the present invention is to provide a fixing structure for connecting a connector and a printed circuit board which may simplify the parts and reduce the cost.

A further objective of the present invention is to provide a fixing structure for connecting a connector and a printed circuit board that may enhance the quality of the product.

In accordance with the present invention, there is provided a fixing structure, comprising:

an insulator, having multiple receptacles for mounting multiple conductors, the insulator having one side having an end face protruded with a chamfered latch boss, and having two sides formed with opposite longitudinal recessed sockets each having a bottom side and an adjoining side formed with a substantially inverted T-shaped through hole; and multiple board locks, integrally formed to include an upper portion defining a substantially inverted U-shaped pivot portion, and a lower portion defining a slender forked insertion portion, each of the pivot portion and the insertion portion having outer sides formed with outward protruded shoulders, the pivot portion having a middle formed with a flexible locking tab that is slightly protruded outward.

Further benefits and advantages of the present invention will become apparent after a careful reading of the detailed description with appropriate reference to the accompanying drawings.

DETAILED DESCRIPTION OF THE INVENTION

Figure 8B:
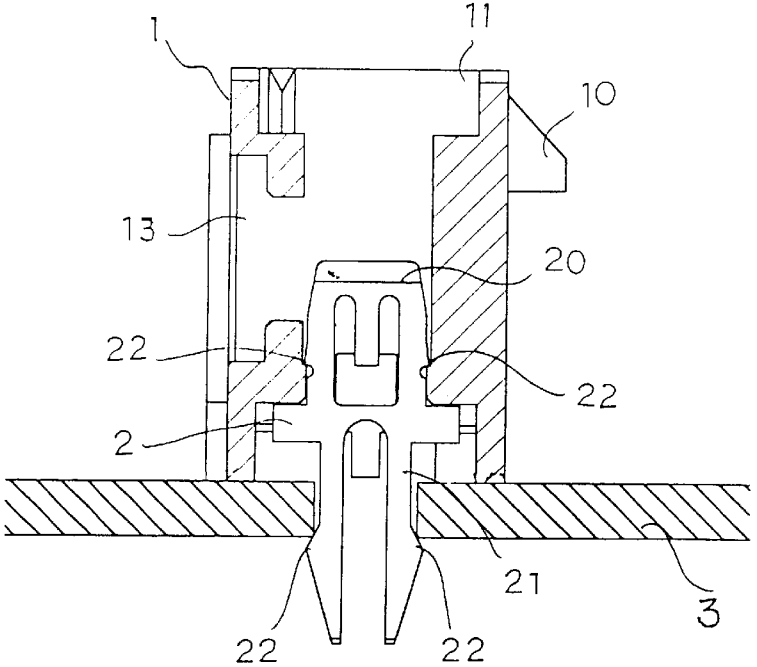
FIG. 8B is a schematic cross-sectional assembly view of the fixing structure for connecting a connector and a printed circuit board as shown in FIG. 1.
Figure 8A:
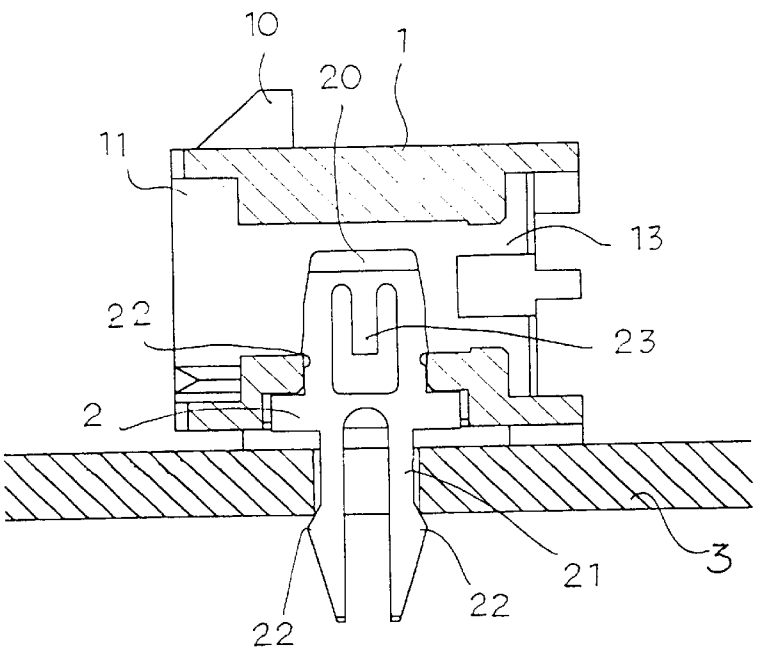
FIG. 8A is a schematic cross-sectional assembly view of the fixing structure for connecting a connector and a printed circuit board as shown in FIG. 1.
Figure 9C:
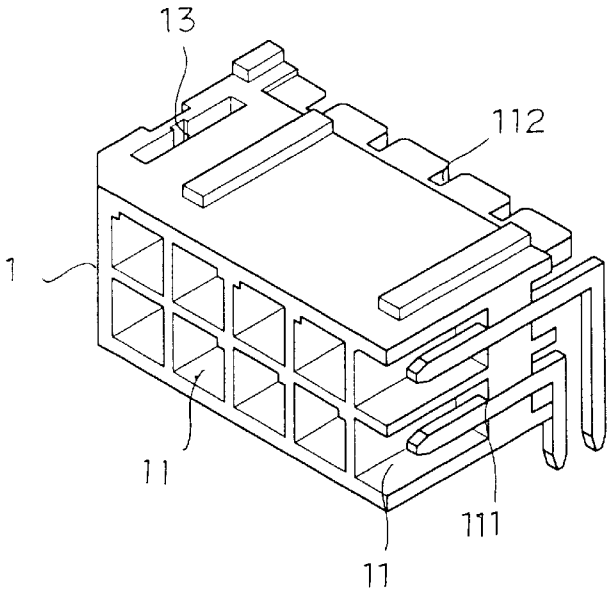
FIG. 9C is a perspective view of an insulator of the fixing structure for connecting a connector and a printed circuit board in accordance with another embodiment of the present invention.
Figure 9B:
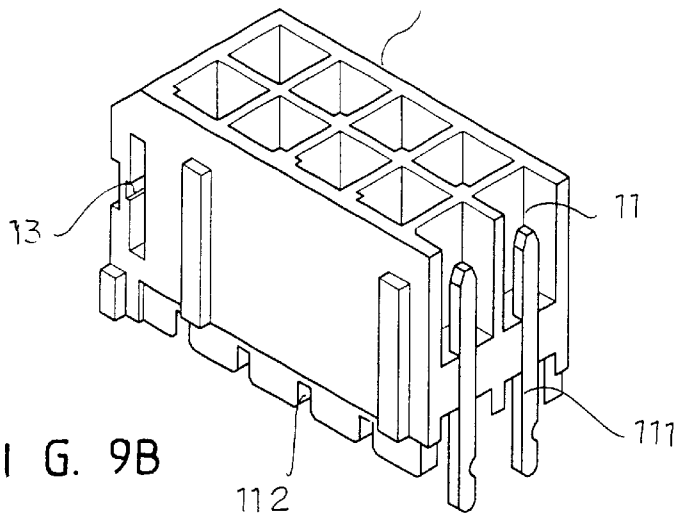
FIG. 9B is a perspective view of an insulator of the fixing structure for connecting a connector and a printed circuit board in accordance with another embodiment of the present invention.
Figure 9A:
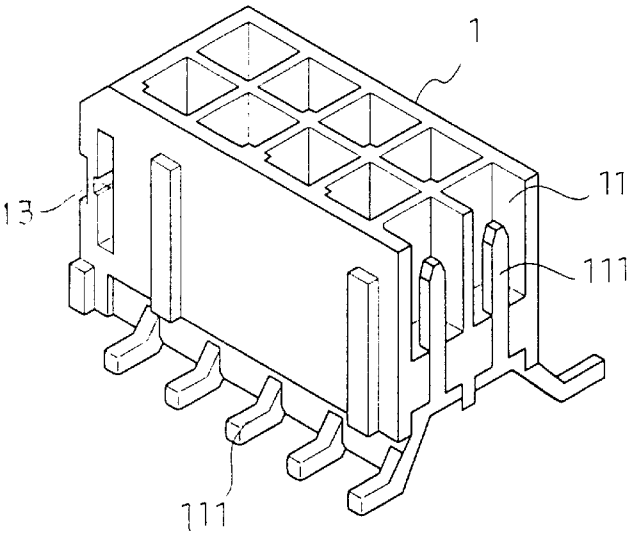
FIG. 9A is a perspective view of an insulator of the fixing structure for connecting a connector and a printed circuit board in accordance with an embodiment of the present invention.
Figure 10:
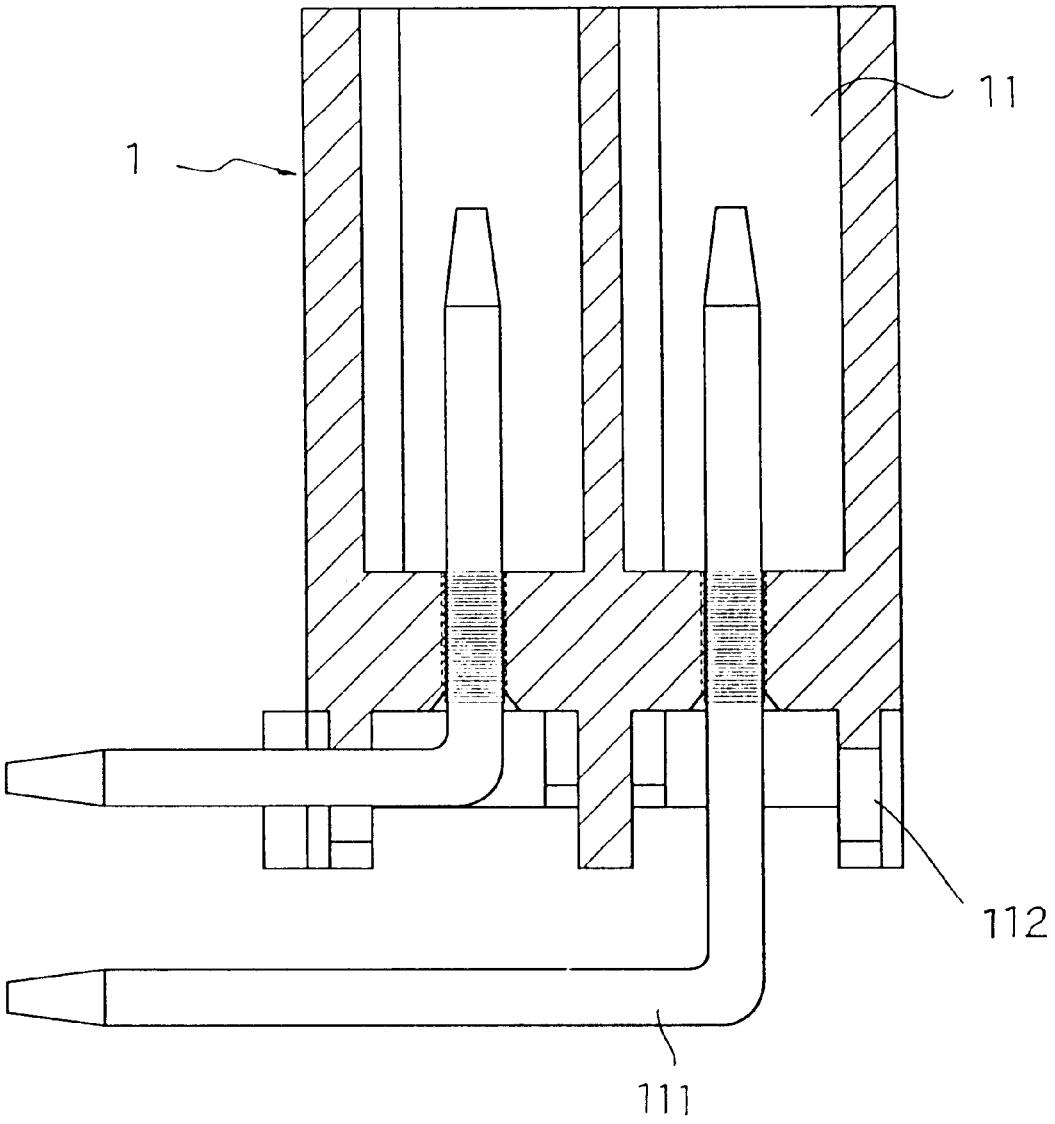
FIG. 10 is a cross-sectional view of the housing of the fixing structure for connecting a connector and a printed circuit board as shown in FIG. 9A.
Figure 11:
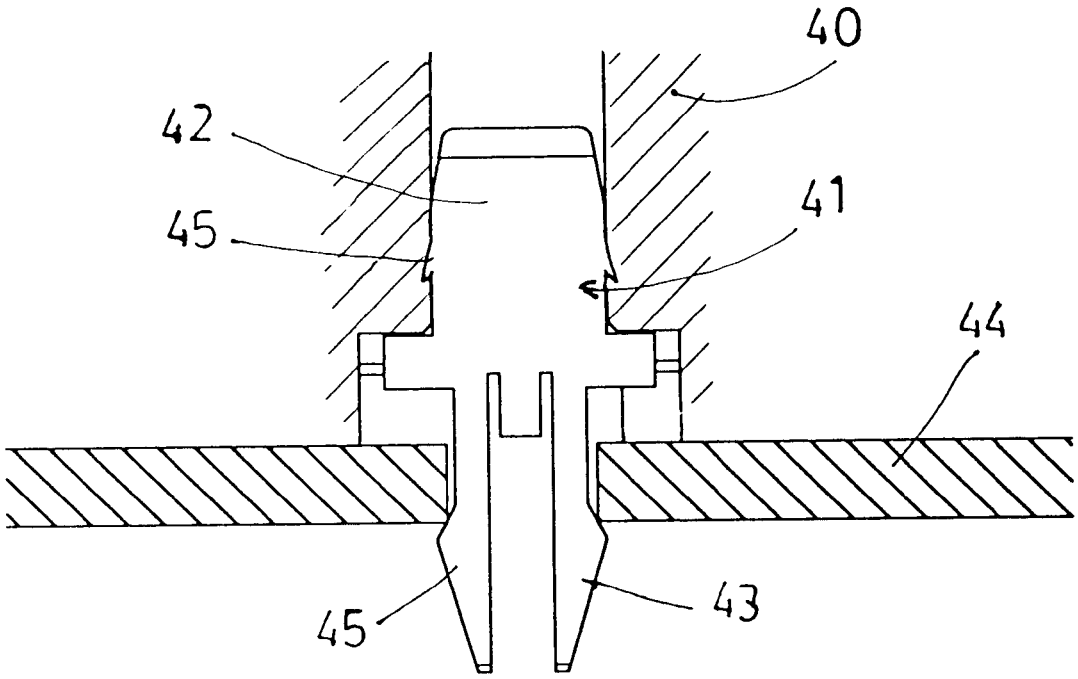
F I G. 11 PRIOR ART
FIG. 11 is a cross-sectional assembly view of a conventional connector in accordance with the prior art.

Referring to the drawings and initially to FIGS. 1–4, a fixing structure for connecting a connector and a printed circuit board in accordance with a first embodiment of the present invention is installed on the surface of a printed circuit board (P.C.B.), and comprises an insulator 1 made of insulating material such as plastic or the like formed by a molding process, and a set of board locks 2 respectively inserted into two sides of the insulator 1 for fixedly mounting the insulator 1 to the printed circuit board 3 (see FIGS. 8A and 8B).

Figure 4:
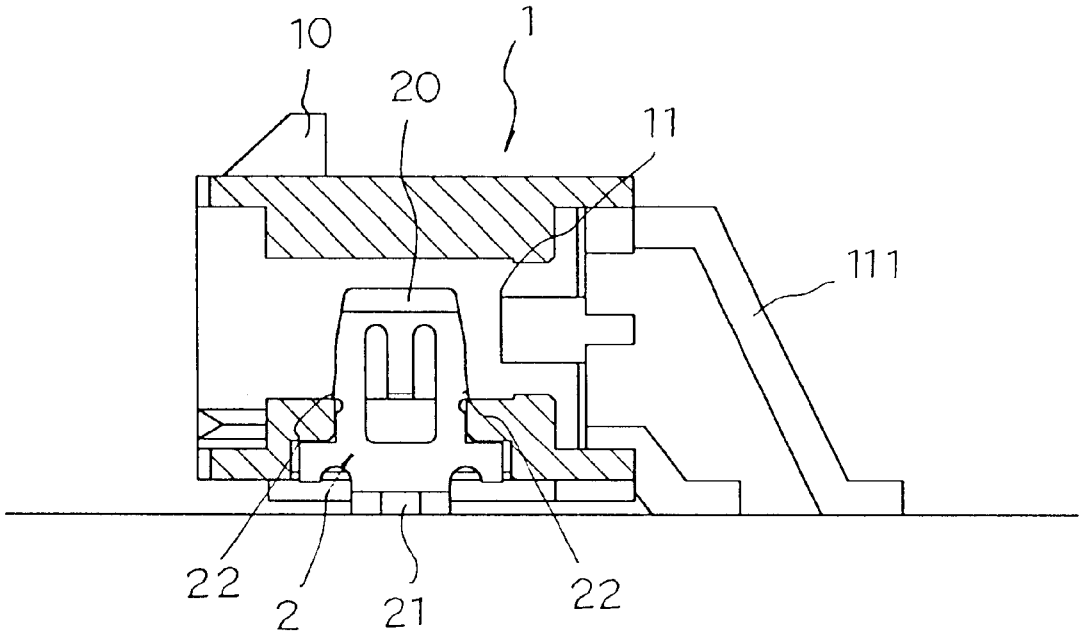
FIG. 4 is a cross-sectional assembly view of the fixing structure for connecting a connector and a printed circuit board as shown in FIG. 3.
Figure 5A:
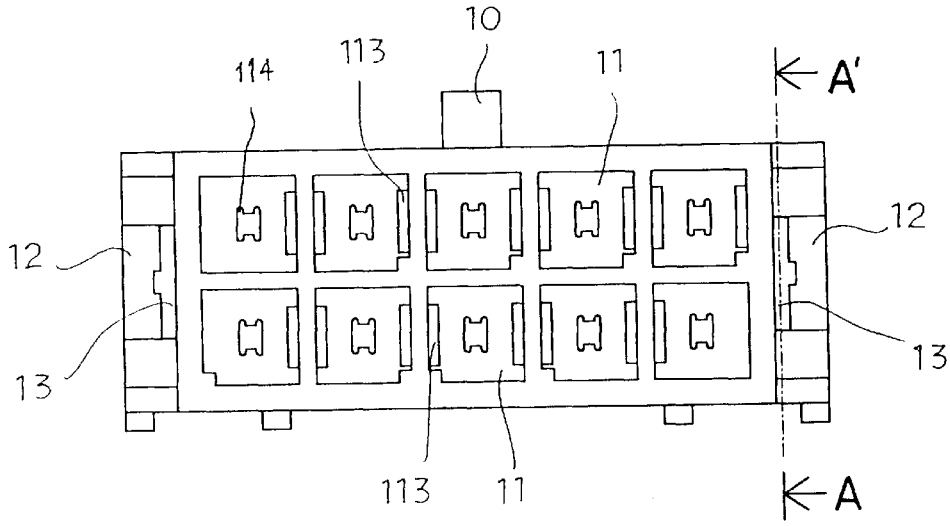
FIG. 5A is a top plan view of the fixing structure for connecting a connector and a printed circuit board as shown in FIG. 1.
Figure 5B:
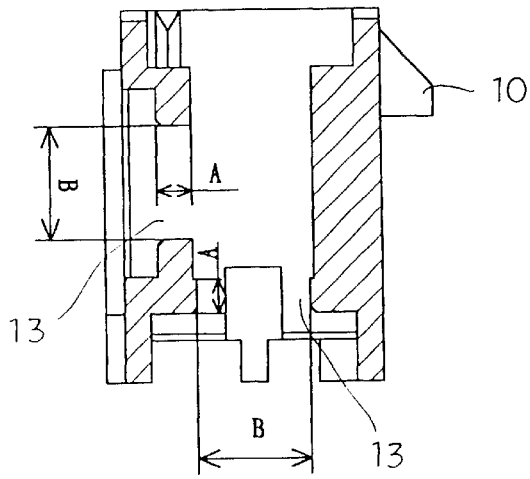
FIG. 5B is a cross-sectional view of the fixing structure for connecting a connector and a printed circuit board as shown in FIG. 5A.

The insulator 1 is provided with multiple conductors 111 that may be connected to proper positions of the printed circuit board 3. The end face of one side of the insulator 1 is protruded with a chamfered latch boss 10 for snapping another connector. The insulator 1 has multiple receptacles 11 that allow insertion of the conductors 111. The insulator 1 has two side faces formed with opposite longitudinal recessed sockets 12 each having a bottom side formed with a substantially inverted T-shaped through hole 13 which allows insertion of the board lock 2 to combine into an integrity as shown in FIGS. 1 and 4.

Figure 1:
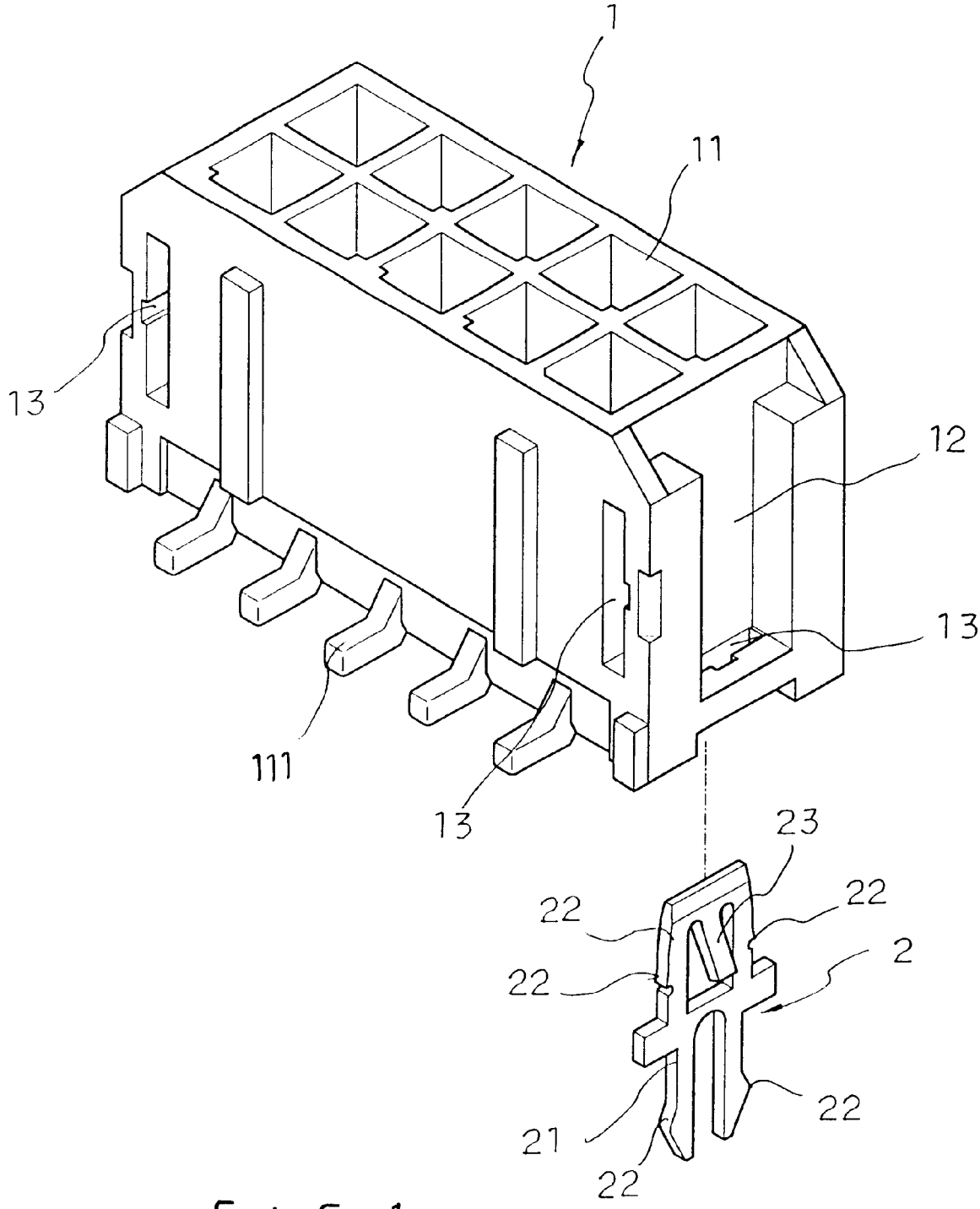
FIG. 1 is an exploded perspective view of a fixing structure for connecting a connector and a printed circuit board in accordance with a first embodiment of the present invention.
Figure 2:
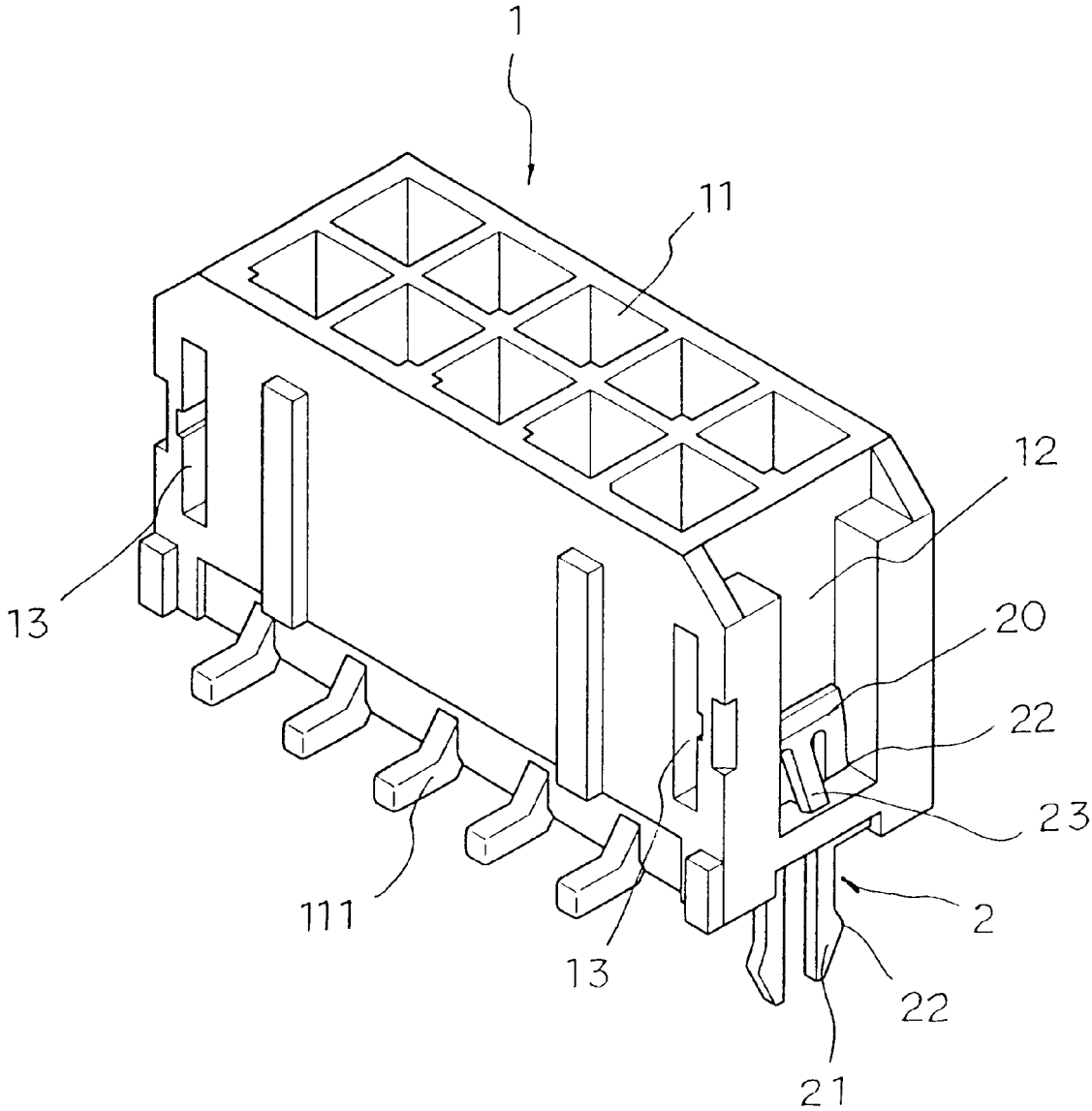
FIG. 2 is a perspective assembly view of the fixing structure for connecting a connector and a printed circuit board as shown in FIG. 1.

Especially, each longitudinal recessed socket 12 has one side also formed with an inverted T-shaped through hole 13 of the same type as shown in FIG. 1, so that the user only needs to rotate the insulator 1 to satisfy the requirements of different printed circuit boards 3 as shown in FIGS. 8A and 8B. thus, the insulator 1 can be adapted to satisfy the common requirements of assembly, thereby simplifying the parts, and reducing the cost.

Figure 3:
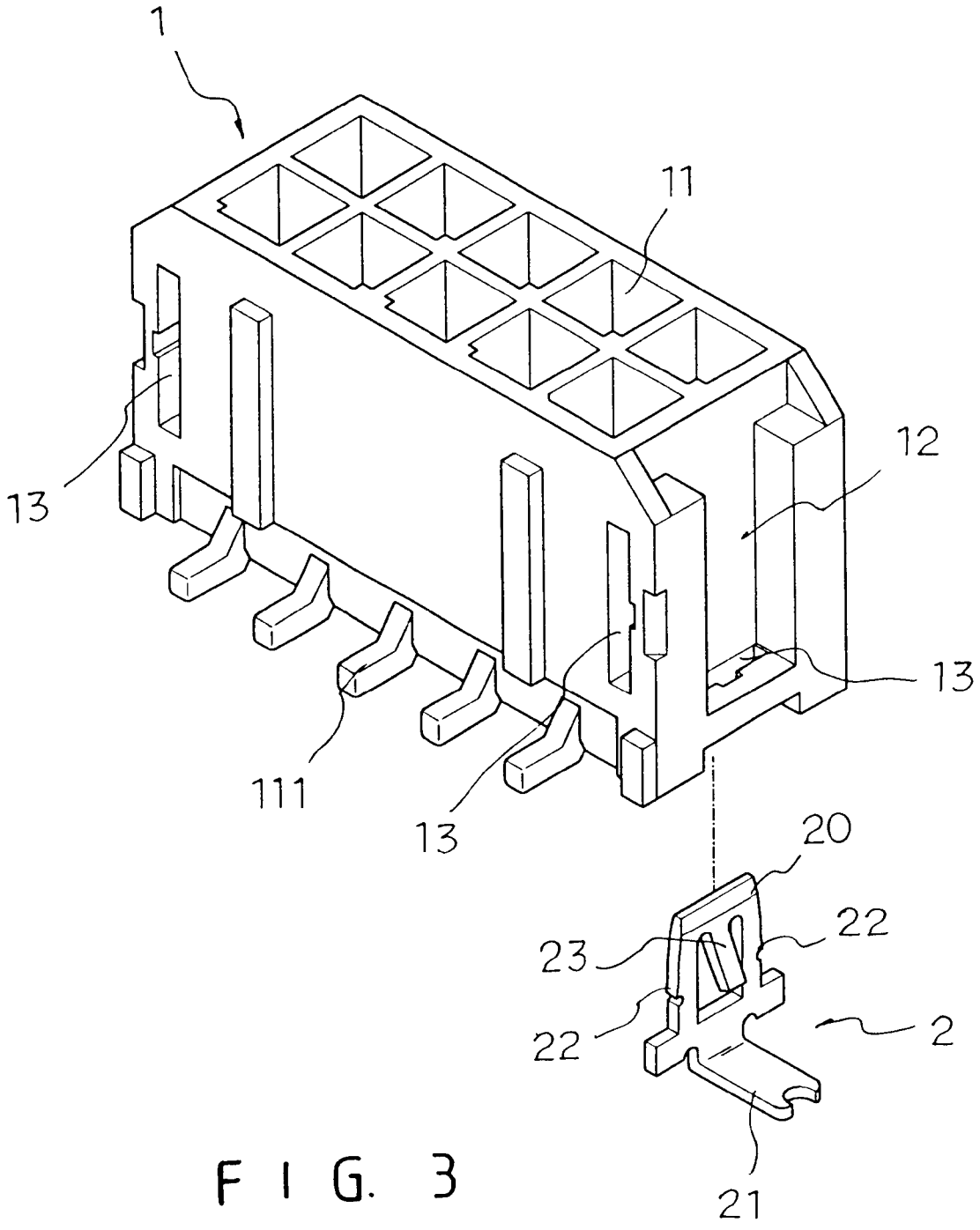
FIG. 3 is a perspective assembly view of the fixing structure for connecting a connector and a printed circuit board in accordance with a second embodiment of the present invention.

The board lock 2 is integrally formed by a punching process or the like, and includes an upper portion defining a substantially inverted U-shaped pivot portion 20, and a lower portion defining a slender forked insertion portion 21 that may be inserted into the printed circuit board 3 to form a positioning state. The outer sides of each of the pivot portion 20 and the insertion portion 21 are formed with outward protruded shoulders 22 for providing a locking positioning effect when the board lock 2 is inserted into the insulator 1 or the printed circuit board 3. Especially, the middle of the pivot portion 20 is formed with a flexible locking tab 23 that is slightly protruded outward. As shown in FIGS. 3 and 4, the insertion portion 21 may be bent at a right angle to smoothly abut the printed circuit board 3.

Figure 6C:
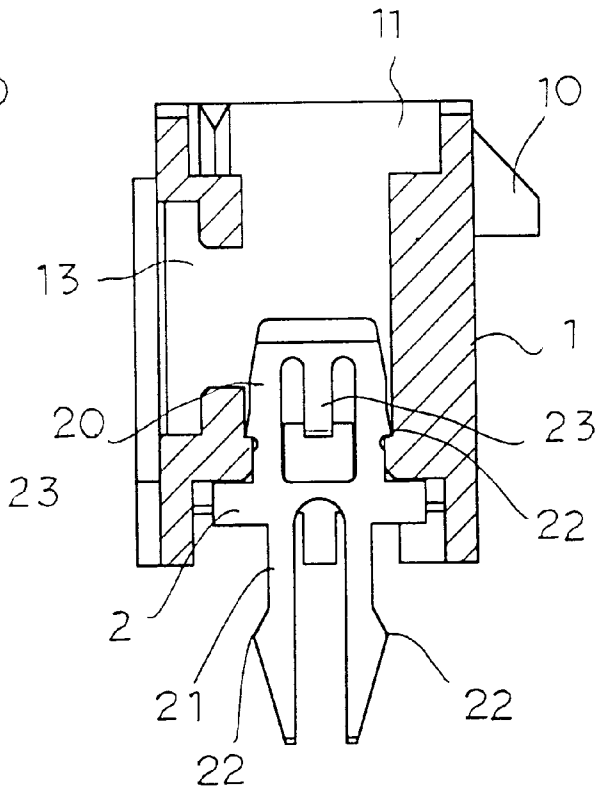
FIG. 6C is a schematic operational view of the fixing structure for connecting a connector and a printed circuit board as shown in FIG. 6B.
Figure 6B:
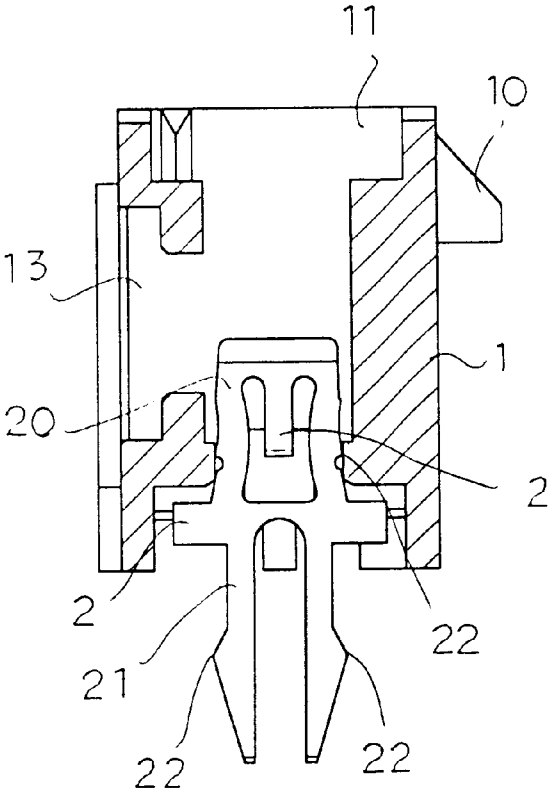
FIG. 6B is a schematic operational view of the fixing structure for connecting a connector and a printed circuit board as shown in FIG. 6A.
Figure 6A:
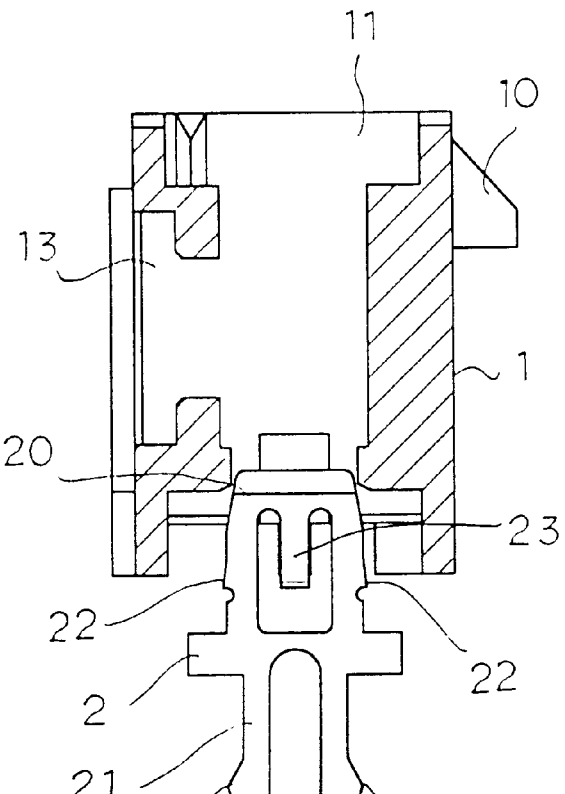
FIG. 6A is a front plan cross-sectional assembly view of the fixing structure for connecting a connector and a printed circuit board as shown in FIG. 1.
Figure 7C:
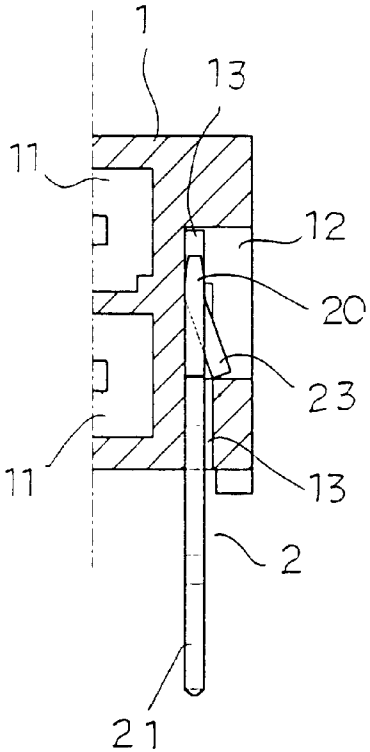
FIG. 7C is a schematic operational view of the fixing structure for connecting a connector and a printed circuit board as shown in FIG. 7B.
Figure 7B:
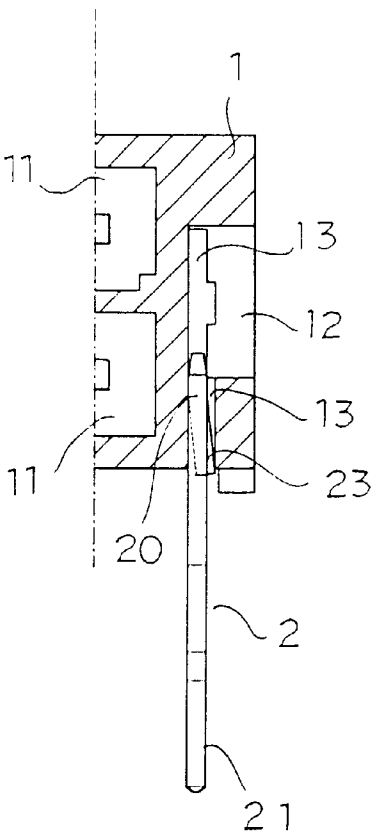
FIG. 7B is a schematic operational view of the fixing structure for connecting a connector and a printed circuit board as shown in FIG. 7A.
Figure 7A:
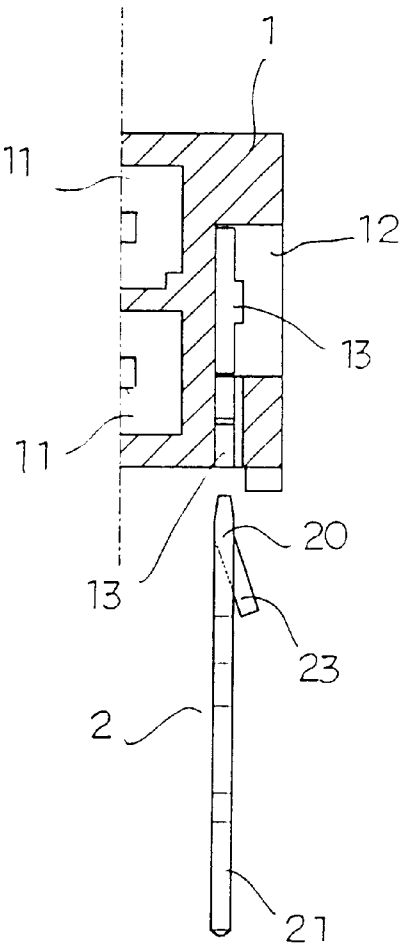
FIG. 7A is a side plan cross-sectional assembly view of the fixing structure for connecting a connector and a printed circuit board as shown in FIG. 1.

In practice, as shown in FIGS. 8A and 8B, the pivot portion 20 may be inserted into the through hole 13 at the bottom side or the adjoining side of the socket 12 of the insulator 1. In such a manner, the shoulders 22 may provide an urging effect as shown in FIGS. 6A, 6B and 6C, while the locking tab 23 is rested on the end face of the periphery of the through hole 13 as shown in FIGS. 7A, 7B and 7C, thereby forming a locking positioning effect, so that the board lock 2 and the insulator 1 are integrally combined rigidly and stably without detachment, thereby further enhancing the quality of the product.

The through hole 13 is especially made with an inverted T-shape, so that the board lock 2 may be inserted into the insulator 1 quickly and exactly, thereby facilitating the assembling process. At the same time, the shoulders 22 may limit displacement of the board lock 2, while the locking tab 23 may form a tight combination effect, thereby preventing the board lock 2 from moving outward.

Referring to FIGS. 5A, 5B, 9 and 10, each receptacle 11 of the insulator 1 has an upper section having a wider passage, a mediate section having a narrower passage, and a lower section having a wider passage. The two side of the bottom of the insulator 1 are formed with multiple positioning recesses 112. At the same time, the two sides of the mediate section having a narrower passage are respectively formed with a hollow 113, and four corners of each receptacle 11 are additionally formed with four receptacle hollows 114. Thus, the conductors 111 can be locked and positioned by the mediate section having a narrower passage, and the positioning recesses 112 can be used to guide the conductors 111, thereby preventing the conductors 111 from tilting. The hollows 113 and the receptacle hollows 114 may distribute the stress diffusion produced when the conductors 111 are inserted and urged, thereby preventing breaking the receptacle 11, and thereby protecting the insulator 1.

The fixing structure of the connector may arbitrarily choose the board locks 2 and the conductors 111 of different kinds to mate with the insulator 1 to satisfy the user's complete and common requirements, thereby enhancing the versatility of the present invention.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A fixing structure, comprising:

an insulator, having multiple receptacles for mounting multiple conductors, each A receptacle of the insulator including an upper section having a wider passage, a mediate section having a narrower passage, and a lower section having a wider passage, the insulator having one side having an end face protruded with a chamfered latch boss, and having two sides formed with opposite longitudinal recessed sockets each having a bottom side and an adjoining side each formed with a substantially inverted T-shaped through hole, the insulator having a bottom face having two sides each formed with multiple positioning recesses each corresponding to each receptacle; and multiple board locks, integrally formed to include an upper portion defining a substantially inverted U-shaped pivot portion, and a lower portion defining a slender forked insertion portion, each of the pivot portion and the insertion portion having outer sides formed with outward protruded shoulders, the pivot portion having a middle formed with a flexible locking tab that is slightly protruded outward, the flexible locking tab being passed through either of substantially inverted thereof hole and rested on an end face of a periphery of the substantially inverted thereof hole.

2. The fixing structure in accordance with claim 1, wherein the insertion portion of the board lock is bent at a right angle with the pivot portion.

* * * * *

UNITED STATES PATENT AND TRADEMARK OFFICE

CERTIFICATE OF CORRECTION

PATENT NO. : 6,471,544 B1
DATED : October 29, 2002
INVENTOR(S) : Alex Huang

It is certified that error appears in the above-identified patent and that said Letters Patent is hereby corrected as shown below:

Title page,
Item [73], Assignee, delete "Ovilux" and substitute therefor -- Cvilux --.

Signed and Sealed this

Eighteenth Day of March, 2003

JAMES E. ROGAN
*Director of the United States Patent and Trademark Office*